United States Patent [19]

Horie et al.

[11] 4,450,219

[45] May 22, 1984

[54] ELECTROPHOTOGRAPHIC PHOTORECEPTOR WITH THIOBARBITURIC ACID DERIVATIVE

[75] Inventors: Seiji Horie; Junji Nakano; Hideo Sato, all of Saitama, Japan

[73] Assignee: Fuji Photo Film Co., Ltd., Kanagawa, Japan

[21] Appl. No.: 391,755

[22] Filed: Jun. 24, 1982

[30] Foreign Application Priority Data

Jun. 24, 1981 [JP] Japan ..... 56-97996

[51] Int. Cl.[3] ..... G03G 5/06

[52] U.S. Cl. ..... 430/59; 430/58; 430/76; 430/77; 430/78; 430/96

[58] Field of Search ..... 430/58, 59, 76, 77, 430/78, 96, 83

[56] References Cited

U.S. PATENT DOCUMENTS

| | | | |
|---|---|---|---|
| 3,536,484 | 10/1970 | Dowden et al. | 430/76 X |
| 4,241,157 | 12/1980 | Webster et al. | 430/78 X |
| 4,389,477 | 6/1983 | Kondo et al. | 430/83 X |
| 4,395,473 | 7/1983 | Horie et al. | 430/58 |

FOREIGN PATENT DOCUMENTS

| | | | |
|---|---|---|---|
| 3117701 | 1/1982 | Fed. Rep. of Germany | 430/77 |
| 49-12669 | 3/1974 | Japan | 430/76 |

*Primary Examiner*—Roland E. Martin, Jr.
*Attorney, Agent, or Firm*—Sughrue, Mion, Zinn, Macpeak and Seas

[57] ABSTRACT

An electrophotographic photoreceptor is disclosed, which is comprised of a conductive support having thereon an electrophotographic photoreceptive layer containing a charge generating material and a charge transporting material. The charge generating material is a particular compound having both a barbituric acid nucleus or thiobarbituric acid nucleus and a heterocyclic ring residue.

15 Claims, 3 Drawing Figures

ELECTROPHOTOGRAPHIC PHOTORECEPTOR WITH THIOBARBITURIC ACID DERIVATIVE

FIELD OF THE INVENTION

The present invention relates to an electrophotographic photoreceptor containing a charge generating material and a charge transporting material. More specifically, the invention relates to an electrophotographic photoreceptor which contains as a charge generating material a particular compound having a barbituric acid nucleus or a thiobarbituric acid nucleus in its photoreceptive layer provided on a conductive support.

BACKGROUND OF THE INVENTION

In general, a photoconduction process which utilizes an electrophotographic photoreceptor, comprises the steps of:

(1) generating electric charges by light-exposure; and (2) transporting the electric charges.

Photoreceptor can be divided into a group in which the steps (1) and (2) above are performed by the same substance, and a group in which they are performed by different substances. A typical example of the former group is a selenium photoreceptor. For the latter group, a combination of amorphous selenium and poly-N-vinyl carbazole is well known. Photoreceptors falling within the latter group have advantages in that a wide range of starting materials can be used in the preparation of the photoreceptors. This may make it possible to increase electrophotographic characteristics such as the sensitivity of photoreceptor and receiving potential, and in that substances suitable for increasing these characteristics can be chosen from a wide range.

Photoconductive materials which have heretofore been used in photoreceptors to be used according to the electrophotographic system include inorganic substances such as selenium, cadmium sulfide, and zinc oxide.

The electrophotographic process disclosed by Carlson in U.S. Pat. No. 2,297,691, uses a photoconductive material comprising a support coated with a substance which is insulative in a dark place and changes its electric resistance depending on the amount of light irradiated during imagewise exposure. In general, the photoconductive material, after being subjected to dark conditioning for a suitable period of time, is uniformly provided with electric charges on the surface thereof in a dark place. Thereafter, the material is exposed imagewise according to a pattern of irradiation having the effect of reducing surface electric charges depending on the relative energy contained in various parts of the pattern. The surface electric charges thus allowed to remain on the photoconductive substance layer (photoreceptive layer), i.e., an electrostatic latent image, is converted into a visible image by bringing the photoconductive substance layer into contact with suitable detection-indicating substances, i.e., toners.

These toners can be drawn to the surface of the photoreceptive layer according to an electric charge pattern even though they are contained in an insulative liquid or in dry carriers. The thus-drawn toners can be fixed by known techniques such as application of heat, pressure or solvent vapor. Furthermore, the electrostatic latent image can be transferred to a second support. Similarly, the electrostatic latent image can be transferred to a second support (e.g., paper and a film) where it is developed. Electrophotography which is so designed as to form images in the above-described manner is one of image-forming processes.

Some of a fundamental characteristics required for the photoreceptor for use in the electrophotographic process are:

(1) It can be charged at a suitable potential in a dark place;

(2) Little or no dissipation of electric charges occurs in a dark place; and (3) Irradiation with light permits rapid dissipation of electric charges.

The above described inorganic substances which have heretofore been used as photoconductive materials suffer from various disadvantages although they have many advantages. For example, selenium that is presently in widespread use sufficiently meets the above requirements (1) to (3). However, use of this material is not desirable because production conditions are severe, production costs are high, flexibility is poor, it is difficult to shape into a belt-like form. Furthermore, care must be taken in handling since it is of low resistance against heat or mechanical impact. Cadmium sulfide and zinc oxide are used as photoreceptors in which they are dispersed in resins as binders. However, they cannot be used repeatedly as such since they are inferior in mechanical properties such as smoothness, hardness, tensile strength, and frictional resistance.

In recent years, to remove the above described defects of the inorganic substances, electrophotographic photoreceptors prepared using various organic substances have been proposed, and some of the photoreceptors have been put into practical use. Examples include a light-sensitive material containing poly-N-vinyl carbazole and 2,4,7-trinitrofluorene-9-on as described in U.S. Pat. No. 3,484,237, a light-sensitive material containing poly-N-vinyl carbazole which is sensitized with pyrylium salt-based dye, as described in Japanese Patent Publication No. 25658/73, a photoreceptor containing organic pigment as a major component as described in Japanese Patent Application (OPI) No. 37543/72 (the term "OPI" is used herein to refer to a "published unexamined Japanese Patent application"), and a photoreceptor containing an eutectic complex of a dye and a resin, as described in Japanese Patent Application (OPI) No. 10735/72. Although these photoreceptors are believed to have excellent characteristics and to be of high practical value, in practice, no photoreceptor sufficiently satisfies all the requirements for a photoreceptor, e.g., convenient to produce, exhibits satisfactory electrophotographic characteristics, and a good wavelength selectivity which is required when the photoreceptor is used as a laser beam printer or an indication element.

SUMMARY OF THE INVENTION

As a result of examining various charge generating substances, it has now been found that compounds having a barbituric acid nucleus or a thiobarbituric acid nucleus (, which are abbreviated as (thio)barbituric acid nucleus hereinafter) represented by the general formula (I) illustrated hereinafter are excellent as charge generating materials. These materials fully satisfy various requirements for electrophotographic photoreceptors, thus achieving the objects of the present invention.

Merocyanine dyes having (thio)barbituric acid nuclei are known as spectral sensitizing dyes for silver salt photography and a number of investigations have been undertaken in this art.

The compounds themselves which are represented by the general formula (I) and which are used in the present invention are not novel ones. Furthermore, Japanese Patent Application (OPI) No. 24628/79 (, which corresponds to U.S. patent application Ser. No. 818,698) disclose that these compounds are used as electrophotographic light-sensitive materials, especially electrically light-sensitive particles in the electrophoretic image forming process. However, these compounds have not been indicated as being photoconductive substances. They have merely been indicated as being used as electrically light-sensitive particles for an electrophoretic image forming process.

We have now found that these compounds possess excellent properties as a charge generating material. Furthermore, we have found that photoreceptors comprised of combinations of these compounds and charge transporting materials exhibit much higher sensitivity than previously believed and have useful photoconductive characteristics.

An example of using compounds having (thio)barbituric acid nuclei as electrophotographic photoreceptors is seen in U.S. Pat. No. 3,536,484. This patent indicates that due to the structure of those compounds that the thiobarbituric acid residue and a substituted phenyl group combine through a pentamethine chain containing a ring structure. The compounds have insufficient stability to light, heat and air oxidation, and low solubility to organic solvents.

The present inventors have found that it is possible to impart the compounds with high resistivities against photooxidation, thermal oxidation and air oxidation. More specifically, the inventor have found that good stability, and good solubility to organic solvents can be imparted to the compounds having (thio)barbituric acid nuclei by making the (thio)barbituric acid residue combine with a heterocyclic residue.

The compounds having (thio)barbituric acid nuclei in the above-described state have now been found to exhibit excellent charge generating functions and further, electrophotographic photoreceptors using the combinations of these compounds and charge transporting materials have now been found to have very high sensitivity. In addition they possess excellent durability and consequently, sufficient electrophotographic characteristics.

Furthermore, it has now been found that it is possible to obtain the wavelength selectivity required upon the application of these electrophotographic photoreceptor to a laser beam printer or display element. It is possible to disperse both the compound having a (thio)barbituric acid nucleus, which acts as a charge generating material, and a charge transporting material homogeneously. When this is accomplished a photoreceptor having high transparency can be obtained.

The present invention is an electrophotographic photoreceptor. It is comprised of an electrophotographic photoreceptive layer containing a charge generating material and a charge transporting material. The charge generating material is a compound having a barbituric acid nucleus or a thiobarbituric acid nucleus represented by the following general formula (I):

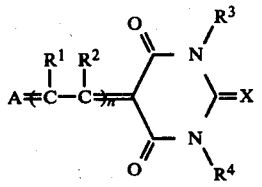

(I)

In the general formula (I), (i) n represents 0, 1 or 2.

(ii) X represents an oxygen atom or a sulfur atom.

(iii) $R^1$ and $R^2$ independently represent a hydrogen atom, an alkyl group, an aralkyl group or an aryl group.

(iv) $R^3$ and $R^4$ independently represent a hydrogen atom, an alkyl group, an aralkyl group or a phenyl group, the latter three groups of which may have some substituents.

(v) A represents a divalent group derived from a heterocyclic ring selected from a group consisting of imidazoles, 3H-indoles, thiazoles, benzothiazoles, naphthothiazoles, thianaphtheno-7',6',4,5-thiazoles, oxazoles, benzoxazoles, naphthooxazoles, selenazoles, benzoselenazoles, naphthoselenazoles, thiazolines, quinolines, isoquinolines, benzimidazoles and pyridines.

In one embodiment of the present invention, the above-described electrophotographic photoreceptive layer is made up of a single layer containing both the above-described charge generating material and the charge transporting material.

In another embodiment of the present invention, the above-described electrophotographic photoreceptive layer is comprised of two layers consisting of a charge generating layer containing the above-described charge generating material and a charge transporting layer containing the charge transporting material.

Figure 1:
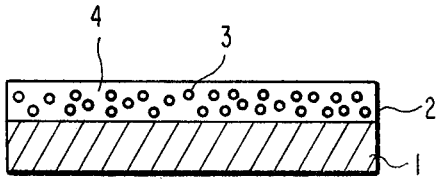
FIGS. 1 to 3 are schematic cross-sectional views of electrophotographic photoreceptors produced in accordance with preferred embodiments of the present invention. These views are illustrated under magnification in their respective thickness directions.

In the drawings the numeral 1 designates a conductive support, the numeral 2 an electrophotographic photoreceptive layer, the numeral 3 a charge generating material, the numeral 4 a charge transporting layer, and the numeral 5 a charge generating layer.

DETAILED DESCRIPTION OF THE INVENTION

The compounds having (thio)barbituric acid nuclei represented by the general formula (I) are described in more detail below.

The small letter n represnts 0, 1 or 2, among which 1 or 2 is preferable.

Specific examples of substituents $R^1$ and $R^2$, include hydrogen; alkyl groups having 1 to 12 carbon atoms such as a methyl group, an ethyl group, a butyl group and an octyl group; aralkyl groups such as a benzyl group and a phenethyl group; and aryl groups such as a phenyl group and a naphthyl group.

Specific examples of substituents $R^3$ and $R^4$, include hydrogen; alkyl groups having 1 to 12 carbon atoms such as a methyl group, an ethyl group, a butyl group and an octyl group; aralkyl groups such as a benzyl group and a phenethyl group; and phenyl groups.

These groups each may have a certain substituent. Examples of substituents include:

(a) an alkyl group having 1 to 4 carbon atoms, such as methyl, ethyl, butyl or so on; (b) an alkoxy group having 1 to 4 carbon atoms, such as methoxy, ethoxy, propoxy or butoxy; (c) an aryloxy group such as a phenoxy, o-, m- or p-tolyloxy; (d) an acyl group such as acetyl, propionyl, benzoyl, or o,m- or p-toluoyl; (e) an alkoxycarbonyl group having 2 to 5 carbon atoms such as methoxycarbonyl, ethoxycarbonyl, propoxycarbonyl or butoxycarbonyl; (f) a halogen atom such as chlorine, bromine or fluorine; (g) a monoalkylamino group the alkyl moiety of which contains 1 to 4 carbon atoms, such as methylamino, ethylamino or butylamino; (h) a dialkylamino group the alkyl moiety of which contains 1 to 4 carbon atoms, such as dimethylamino, diethylamino, dipropylamino, dibutylamino or N-methyl-N-ethylamino; (i) an amido group such as acetoamido or propionamido; and (j) other substituents such as nitro.

(A) represents a divalent group derived from a heterocyclic ring selected from a group consisting of the following compounds. They may be grouped into the following classes (a) to (q):

(a) Imidazoles, such as 4-phenylimidazole, 4-phenyl-3-ethyl-2,3-dihydroimidazole, 1,3-dimethyl-2,3-dihydroimidazole and 1,3-diethyl-2,3-dihydroimidazole.

(b) 3H-indoles, such as 3H-indole, 3,3-dimethyl-3H-indole, 1,3,3-trimethyl-3H-indole, 1-ethyl-3,3-dimethyl-3H-indole, 1-butyl-3,3-dimethyl-3H-indole, 5-methoxy-1,3,3-trimethyl-3H-indole, 5-ethoxycarbonyl-1-ethyl-3,3-dimethyl-3H-indole and 3,3,5-trimethyl-3H-indole.

(c) Thiazoles, such as thiazole, 4-methylthiazole, 4-phenylthiazole, 5-methylthiazole, 5-phenylthiazole, 4,5-dimethylthiazole, 4,5-diphenylthiazole, 4-(2-thienyl)thiazole, 3-methyl-2,3-dihydrothiazole and 3-ethyl-2,3-dihydrothiazole.

(d) Benzothiazoles, such as benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-methylenedioxybenzothiazole, 6-hydroxybenzothiazole, 3-methyl-2,3-dihydrobenzothiazole and 3-ethyl-2,3-dihydrobenzothiazole.

(e) Naphthothiazoles, such as naphtho[1,2-d]thiazole, naphto[2,1-d]thiazole, naphtho[2,3-d]thiazole, 5-methoxynaphtho[2,1-d]thiazole, 5-ethoxynaphtho[2,1.d]thiazole, 8-methoxynaphtho[1,2-d]thiazole, 7-methoxynaphtho[1,2-d]thiazole, 3-methyl-2,3-dihydronaphtho[1,2-d]thiazole and 3-ethyl-2,3-dihydronaphtho[1,2-d]thiazole.

(f) Thianaphtheno[7,6-d]thiazoles, such as 5-methoxythianaphtheno[7,6-d]thiazole, 1-methyl-1,2-dihydrothianaphtheno[7,6-d]thiazole and 1-ethyl-1,2-dihydrothianaphtheno[7,6-d]thiazole.

(g) Oxazoles, such as 4-methyloxazole, 5-methyloxazole, 4-phenyloxazole, 4,5-diphenyloxazole, 4-ethyloxazole, 4,5-dimethyloxazole, 5-phenyloxazole, 3-methyl-2,3-dihydrooxazole and 3-ethyl-2,3-dihydrooxazole.

(h) Benzoxazoles, such as benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-methoxybenzoxazole, 5-ethoxybenzoxazole, 5-chlorobenzoxazole, 6-methoxybenzoxazole, 5-hydroxybenzoxazole, 6-hydroxybenzoxazole, 3-methyl-2,3-dihydroxybenzoxazole and 3-ethyl-2,3-dihydrobenzoxazole.

(i) Naphtoxazoles, such as naphto[1,2-d]oxazole, naphtho[2,1-d]oxazole, 1-methyl-1,2-dihydronaphtho[1,2-d]oxazole and 3-ethyl-2,3-dihydronaphtho[2,1-d]oxazole.

(j) Selenazoles, such as 4-methylselenazole, 4-phenylselenazole, 3-methyl-2,3-dihydroselenazole and 3-ethyl-2,3-dihydroselenazole.

(k) Benzoselenazoles, such as benzoselenazole, 5-chlorobenzoselenazole, 5-methoxybenzoselenazole, 5-hydroxybenzoselenazole, 4,5,6,7-tetrahydrobenzoselenazole, 3-methyl-2,3-dihydroselenazole and 3-ethyl-2,3-dihydrobenzoselenazole.

(l) Naphthoselenazoles, such as naphtho[1,2-d]selenazole, naphtho[2,1-d]selenazole, 1-ethyl-1,2-dihydro[1,2-d]selenazole and 3-methyl-2,3-dihydronaphtho[2,1-d]selenazole.

(m) Thiazolines, such as 2-thiazoline, 4-thiazoline, 3-methyl-4-thiazoline and 3-ethyl-4-thiazoline.

(n) Quinolines, such as quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, 8-hydroxyquinoline, 1-methyl-1,2-dihydroquinoline, 1-ethyl-1,2-dihydroquinoline, 1-methyl-1,4-dihydroquinoline and 1-ethyl-1,4-dihydroquinoline.

(o) Isoquinolines, such as isoquinoline, 3,4-dihydroisoquinoline, 2-methyl-1,2-dihydroisoquinoline and 2-ethyl-1,2-dihydroisoquinoline.

(p) Benzimidazoles, such as 1,3-dimethyl-2,3-dihydrobenzoimidazole, 1,3-diethyl-2,3-dihydrobenzimidazole and 1-ethyl-3-phenyl-2,3-dihydrobenzimidazole.

(q) Pyridines, such as pyridine, 5-methylpyridine, 1-methyl-1,2-dihydropyridine, 1-ethyl-1,2-dihydropyridine, 1-methyl-1,4-dihydropyridine and 1-ethyl-1,4-dihydropyridine.

All of the divalent groups derived from the above-described heterocyclic ring compounds are those which are well-known in cyanine dyes and merocyanine dyes.

Specific examples of the compound having a (thio)-barbituric nucleus represented by the general formula (I) are illustrated below. In the following chemical structural formulae, all Me's and all Et's represent $CH_3$ (methyl) and $C_2H_5$ (ethyl), respectively.

Compound (1)

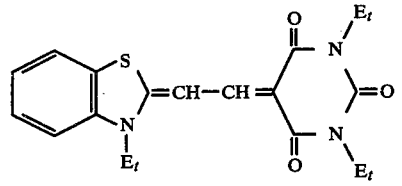

Compound (2)

-continued
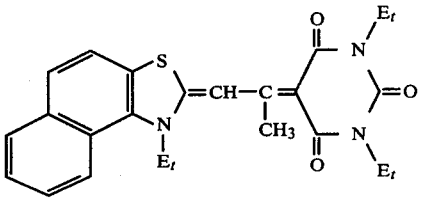
Compound (3)
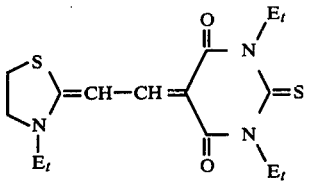
Compound (4)
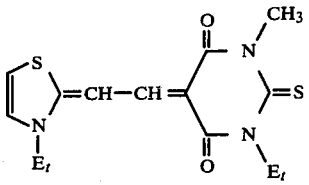
Compound (5)
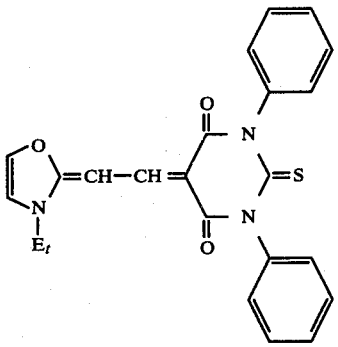
Compound (6)
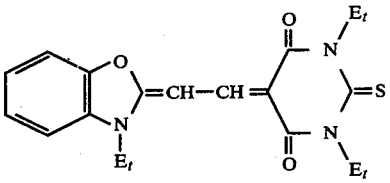
Compound (7)
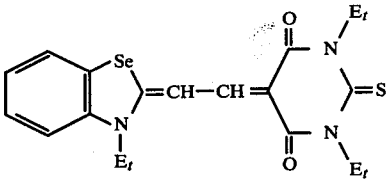
Compound (8)
-continued
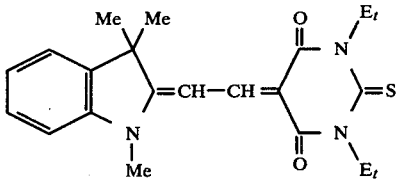
Compound (9)
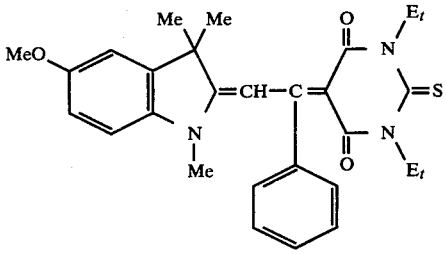
Compound (10)
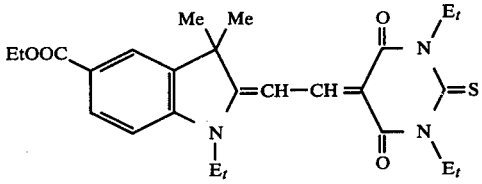
Compound (11)
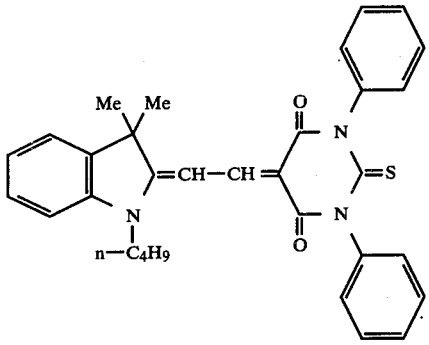
Compound (12)
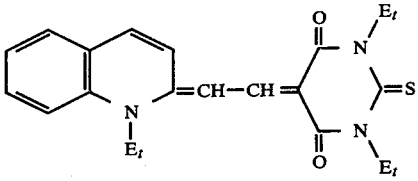
Compound (13)
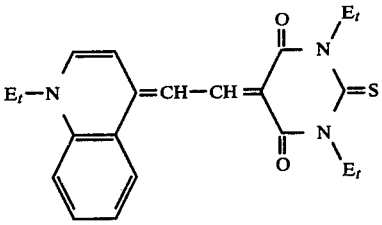
Compound (14)

-continued

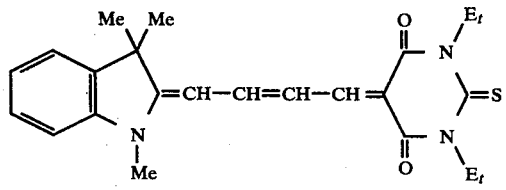

Compound (15)

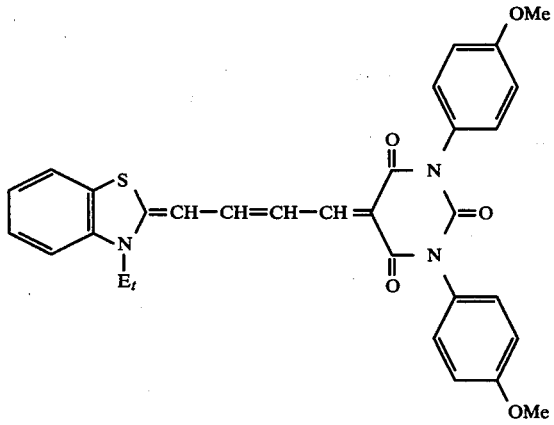

Compound (16)

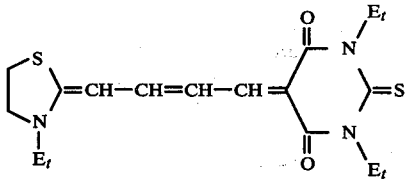

The (thio)barbituric acid nucleus-containing compounds represented by the general formula (I) can be produced using methods described in U.S. Pat. Nos. 2,036,546; 2,089,729; 2,165,338; 2,170,803; 2,170,807; 2,263,757 and 2,519,001.

The present invention utilizes such compounds having (thio)barbituric acid nuclei as described above as a charge generating material. This material is used in combination with a charge transporting material. The electrophotographic photoreceptor of the present invention may take various configurations as illustrated in FIGS. 1 to 3 depending upon the way of applying the charge generating material having the (thio)barbituric acid nucleus to its photoreceptive layer.

The photoreceptor shown in FIG. 1 is comprised of a conductive support 1 in which at least the surface must have conductivity, and an electrophotographic photoreceptive layer 2 in which a compound 3 having a (thio)barbituric acid nucleus which acts as a charge generating material is dispersed homogeneously or heterogeneously in a charge transporting medium 4 comprised of a charge transporting material and a binder.

Figure 2:
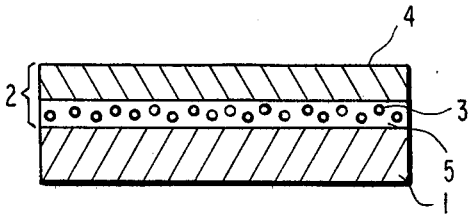

The photoreceptor shown in FIG. 2 is comprised of a support 1, wherein at least the surface of the support is conductive, an electrophotographic photoreceptive layer 2 which is comprised of a charge generating layer 5 containing as a main component a (thio)barbituric acid nucleus-containing compound 3 in a form of a homogeneous or heterogeneous dispersion and a charge transporting layer 4 containing a charge transporting material. The two layers being provided on the support in this order.

Figure 3:
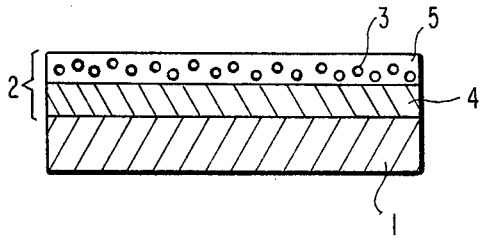

Another photoreceptor is shown in FIG. 3 which is comprised of a conductive support 1, at least the surface of which must be conductive. On the surface, in sequence, is placed a charge transporting layer 4 containing a charge transporting material, and a charge generating layer 5 containing as a main component a (thio)barbituric acid nucleus-containing compound 3 in the form of homogeneous or heterogeneous dispersion. The latter two layers constituting an electrophotographic photoreceptive layer 2.

The photoreceptor shown in FIG. 1 is prepared in a manner such that a (thio)barbituric acid nucleus-containing compound is dissolved or dispersed in a solution wherein a charge transporting material and a binder are dissolved. The resulting composition is coated on a conductive support, and dried.

The photoreceptor shown in FIG. 2 is obtained as follows: A (thio)barbituric acid nucleus-containing material possessing the charge generating ability is subjected to vacuum deposition processing to evaporate the film thereof onto a conductive support. Alternatively, it may be dissolved or dispersed in a proper solvent, wherein a binder is optionally dissolved, coated and dried. Further, after surface finishing, if necessary, using a buff rubbing technique or the like, or thickness adjustment, a solution containing a charge transporting material and a binder is coated on the above-described layer, and dried. Therein, the coating step may be carried out using conventional means, for example, doctor blade, wire bar or so on.

The photoreceptor shown in FIG. 3 is obtained as follows: A solution containing a charge transporting material and a binder is coated on a conductive support using a conventional means, and dried. Thereon, a charge generating layer is, then, provided in the same manner as in the photoreceptor of FIG. 2.

The thickness of a photoreceptive layer in FIG. 1 is 3 to 50 μm, preferably 5 to 20 μm. The thickness of a charge generating layer is 5 μm or less, preferably 2 μm or less, in both FIG. 2 and FIG. 3. The thickness of a charge transporting layer is 30 to 50 μm, preferably 5 to 20 μm, in both FIG. 2 and FIG. 3.

In the photoreceptor of FIG. 1, the proportion of charge transporting material in the photoreceptive layer is 10 to 150 wt%, preferably 30 to 100 wt%, with respect to the binder used, and the proportion of the compound having a (thio)barbituric acid nucleus in the photoreceptive layer is 1 to 150 wt%, preferably 5 to 50 wt%, with respect to the binder used.

In the photoreceptor of FIG. 2 or FIG. 3, the proportion of a charge transporting material in the charge transporting layer is 10 to 150 wt%, preferably 30 to 100 wt%, in analogy with the photoreceptive layer of the photoreceptor in FIG. 1. In addition, in every photoreceptor shown in FIGS. 1 to 3, a plasticizer can be incorporated together with a binder. Further, in the case of the charge generating layer containing a charge generating material dispersed in a macro-molecular binder, the macromolecular binder is preferably used in a proportion of 10 parts by weight or less to 1 part by weight of a compound having a (thio)barbituric acid nucleus.

In the electrophotographic photoreceptor of the present invention, a layer made substantially of a (thio)barbituric acid nucleus-containing compound alone can be used as a charge generating layer. This can be accomplished by evaporating a (thio)barbituric acid nucleus-containing compound onto a conductive support or a charge transporting layer, or by dissolving or dispersing the compound in a solvent capable of being removed by vaporization, coating on a conductive support or a charge transporting layer and drying, resulting in the formation of a charge generating layer.

A plate or a foil of metal like aluminium, a plastic film on which a film of metal like aluminium is evaporated, or a sheet of paper which received conduction processing may be used as a conductive support, provided at least the surface of the support has conductivity. Useful binder include a condensation resin such as polyamide, polyurethane, polyester, epoxy resin, polyketone and polycarbonate. A vinyl polymer such as polyvinyl ketone, polystyrene, poly-N-vinylcarbazole or polyacrylamide; or the like can be used. Any resin possessing both insulating and adhesive properties can be used.

Examples of useful plasticizers include biphenyl, biphenyl chloride, o-terphenyl, p-terphenyl, dibutyl phthalate, dimethylglycol phthalate, dioctyl phthalate, triphenyl phosphate, methylnaphthalene, benzophenone, chlorinated paraffins, polypropylene, polystyrene, dilauryl thiodipropionate, 3,5-dinitrosalicylic acid, various kinds of fluorohydrocarbons and so on.

Charge transporting materials which can be employed in electrophotographic photoreceptors shown in FIGS. 1 to 3, include triphenylamine derivatives disclosed in U.S. Pat. No. 3,567,450; Japanese Patent Publication 35702/74; West German Pat. (DAS) No. 1,110,518; and so on: polyarylalkane derivatives disclosed in U.S. Pat. No. 3,542,544; Japanese Patent Publication 555/70; Japanese Patent Application (OPI) 93224/76; and so on: pyrazoline derivatives disclosed in Japanese Patent Applications (OPI) 72231/77 and 105537/74; Japanese Patent Publication 4188/77; and so on: hydrazone derivatives disclosed in U.S. Pat. No. 3,717,462; Japanese Patent Application (OPI) 59143/79 (corresponding to U.S. Pat. No. 4,150,987), Japanese Patent Applications (OPI) 52063/80, 53064/80, 46760/80 and 85495/80; Japanese Patent Application 85495/80; and so on. These charge transporting materials can be used alone or in combination depending upon circumstances.

In the present invention, the photoreceptor can be controlled to obtain photosensitivity in any desired wavelength range by properly combining two or more (thio)barbituric acid nucleus-containing compounds which differ from each other in the wavelength range wherein the compound has photo-sensitivity. Photosensitivity can also be controlled by combining these compounds with known dye sensitizers.

In addition, in the photoreceptor prepared in the above-described manner, an adhesive layer or barrier layer can be optionally provided between the conductive support and the photoreceptive layer. Materials which can be employed in such a layer include polyamide, nitrocellulose, aluminium oxide and so on, and a preferable thickness of such a layer is 1 μm or less.

The photoreceptors of the present invention have very high sensitivity, can be prepared by a simple process and exhibit excellent durability. In addition, they have the advantage that the wavelength selectivity which is required upon the application of electrophotographic photo-receptors to a laser beam printer or display element is very high.

Further, the electrophotographic photoreceptors of the present invention are advantageous from an industrial point of view, in that printing plates (lithograph or relief plate) having high resolution, high durability and high sensitivity can be obtained through the steps of imagewise exposure, toner image formation and etching.

The present invention will now be illustrated in more detail by reference to the following examples. However, the present invention should not be construed as being limited to the following examples. In the following examples, all parts are by weight, unless otherwise indicated.

EXAMPLE 1

2 Parts of hydrazone compound having the following structural formula as a charge transporting material, and 5 parts of polycarbonate of bisphenol A were dissolved in 130 parts of dichloromethane.

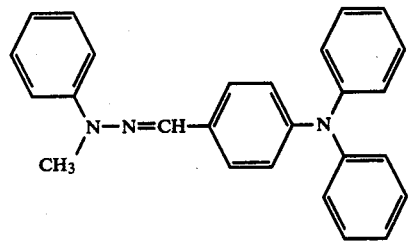

To the solution of the charge transporting material, one part of Compound (8) having the thiobarbituric acid nucleus was added to prepare a coating solution for an electrophotographic photoreceptive layer.

The thus prepared coating solution was coated on a conductive transparent support (which had an evaporation film of indium oxide on a 100 μm-thick polyethylene terephthalate support, and surface resistance of $10^3\Omega$) using wire wound rod, and dried. Thus, an electrophotographic photoreceptor having an about 8 μm-thick electrophotographic photoreceptive layer of single layer type was obtained.

In order to evaluate this photoreceptor, its half decay exposure was investigated using an electrostatic copying paper testing apparatus (made by Kawaguchi Electric Mfg. Co., Ltd., Model SP-428) in the following manner: The photoreceptor was made to create +800 V of potential on its surface by +5 kV of corona charging and then, exposed to monochromatic visible radiation having a wavelength of 497 nm and such an intensity that illuminance at the surface of the electrophotographic photoreceptive layer might be adjusted to 30 [erg/cm$^2$.sec].

The time required for the surface potential to be reduced to one-half its initial value was measured and thereby, a half decay exposure $E_{\frac{1}{2}}$[erg/cm$^2$] was determined. $E_{\frac{1}{2}}$ of this photoreceptor was 72 [erg/cm$^2$].

EXAMPLES 2 TO 6

Photoreceptors were prepared in the same manner as in Example 1 except that (thio)barbituric acid nucleus-containing compounds set forth in Table 1 were employed respectively instead of the charge generating material used in Example 1. Half decay exposure values of the thus prepared photoreceptors were also determined in the same manner as in Example 1 except that exposure was carried out using monochromatic visible radiations having their respective wavelengths set forth in Table 1 instead of 497 nm employed in Example 1. $E_{\frac{1}{2}}$ values determined are shown in Table 1.

TABLE

| Example No. | Compound* No. | Addition Amount** [part] | Wavelength of Radiation [nm] | $E_{\frac{1}{2}}$ [erg/cm$^2$] |
|---|---|---|---|---|
| 2 | (1) | 0.15 | 509 | 178 |
| 3 | (3) | 1.00 | 452 | 70 |
| 4 | (12) | 0.20 | 538 | 167 |
| 5 | (13) | 0.05 | 588 | 353 |
| 6 | (14) | 1.00 | 596 | 161 |

*Compound having a barbituric acid nucleus
**Addition amount of the compound having the barbituric acid nucleus

EXAMPLE 7

4 Parts of 4,4'-bis(diethylamino)-2,2'-dimethyltriphenylmethane as a charge transporting material, and 5 parts of polycarbonate of bisphenol A were dissolved in 130 parts of dichloromethane. To the solution of the charge transporting material, 1 part of Compound (3), which has a thiobarbituric acid nucleus, was added to make the solution. Thus, a coating solution for an electrophotographic photoreceptive layer was prepared.

This coating solution was coated and dried in the same manner as in Example 1 to make a photoreceptor having a 7 μm-thick electrophotographic photoreceptive layer of the single layer type.

$E_{\frac{1}{2}}$ was determined in the same manner as in Example 1 except that monochromatic visible radiation having a wavelength of 452 nm was used instead of the radiation used in Example 1. $E_{\frac{1}{2}}$ of the thus prepared photoreceptor was 33 [erg/cm$^2$].

EXAMPLE 8

The thiobarbituric acid nucleus-containing compound (8) was evaporated onto a 100 μm-thick aluminium plate, which had received graining processing, under conditions that the pressure inside the evaporation system was controlled to $2\times10^{-5}$ Torr, the evaporation temperature was 300° C. and the evaporation time was 15 minutes, to provide a 0.5 μm-thick charge generating layer.

Next, 5 parts of 4,4'-bis(diethylamino)-2,2'-dimethyltriphenylmethane to act as a charge transporting material and 4 parts of polycarbonate of bisphenol A were dissolved in 100 parts of dichloromethane. The resulting solution was coated on the above-described charge generating layer using a rotary coating process, and dried. Thus, a 7 μm-thick electrophotographic photoreceptor having an integral laminate type of electrophotographic photoreceptive layer was obtained.

The sensitivity of this photoreceptor was determined in the same manner as in Example 1, and $E_{\frac{1}{2}}$ was 203 [erg/cm$^2$].

Thus, as is apparent from the result that the sensitivity of the photoreceptor containing no charge generating material was low showing $10^4$ or more [erg/cm$^2$] of $E_{\frac{1}{2}}$, the photoreceptor of the present invention has an extraordinally higher sensitivity.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrophotographic photoreceptive layer containing a charge generating material and a charge transporting material, said charge generating material being a compound which has a barbituric acid nucleus or a thiobarbituric acid nucleus represented by the following general formula (I):

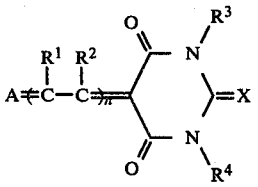

(I)

wherein n represents 0, 1 or 2; X represents an oxygen atom or a sulfur atom; $R^1$ and $R^2$ independently represent a hydrogen atom, an alkyl group, an aralkyl group or an aryl group; $R^3$ and $R^4$ independently represent a hydrogen atom, an alkyl group, an aralkyl group or a phenyl group, wherein the alkyl, aralkyl or phenyl groups may be substituted; and A represents a divalent group derived from a heterocyclic ring selected from a group consisting of imidazoles, 3H-indoles, thiazoles, benzothiazoles, naphthothiazoles, thianaphtheno-7',6',4,5-thiazoles, oxazoles, benzoxazoles, naphthoxazoles, selenazoles, benzoselenazoles, naphthoselenazoles, thiazolines, quinolines, isoquinolines, benzimidazoles and pyridines.

2. The electrophotographic photoreceptor as claimed in claim 1, wherein said electrophotographic photoreceptive layer consists of a single layer containing the charge generating material, the charge transporting material, and a binder.

3. The electrophotographic photoreceptor as claimed in claim 1, wherein said electrophotographic photoreceptive layer consists of the combination of a charge generating layer containing the charge generating material and a charge transporting layer containing the charge transporting material.

4. An electrophotographic photoreceptor as claimed in claim 2, wherein the thickness of the photoreceptive layer is from 3 to 50 μm.

5. An electrophotographic photoreceptor as claimed in claim 2, wherein the thickness of the photoreceptive layer is from 5 to 20 μm.

6. An electrophotographic photoreceptor as claimed in claim 3, wherein the thickness of the charge transporting layer is from 3 to 50 μm.

7. An electrophotographic photoreceptor as claimed in claim 3, wherein the thickness of the charge transporting layer is from 5 to 20 μm.

8. An electrophotographic photoreceptor as claimed in claim 3, wherein the thickness of the charge generating layer is 5 μm or less.

9. An electrophotographic photoreceptor as claimed in claim 3, wherein the thickness of the charge generating layer is 2 μm or less.

10. An electrophotographic photoreceptor as claimed in claim 2, wherein the charge transporting material in the photoreceptive layer is contained in an amount of 10 to 150 wt.% with respect to the binder, and further wherein the proportion of the compound having a thiobarbituric acid nucleus in the photoreceptive layer is 1 to 150 wt% with respect to the binder.

11. An electrophotographic photoreceptor as claimed in claim 2, wherein the proportion of the charge transporting material in the photoreceptive layer is 30 to 100 wt% with respect to the binder, and further wherein the proportion of the compound having a thiobarbituric acid nucleus in the photoreceptive layer is 5 to 50 wt% with respect to the binder.

12. An electrophotographic photoreceptor as claimed in claim 3, wherein the proportion of the charge transporting material in the charge transporting layer is 30 to 100 wt% with respect to the binder, and further wherein the proportion of the binder in the charge generating layer is 10 parts by weight or less with respect to 1 part by weight of the compound having a thiobarbituric acid nucleus in the case of the compound being dispersed in the binder.

13. An electrophotographic photoreceptor comprising an electrophotographic photoreceptive layer containing a charge generating material and a charge transporting material, said charge generating material being dispersed homogeneously in said layer and a compound which has a barbituric acid nucleus or a thiobarbituric acid nucleus represented by the following general formula (I):

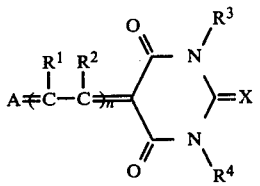

(I)

wherein n represents 0, 1 or 2; X represents an oxygen atom or a sulfur atom; $R^1$ and $R^2$ independently represent a hydrogen atom, an alkyl group, an aralkyl group or an aryl group; $R^3$ and $R^4$ independently represent a hydrogen atom, an alkyl group, an aralkyl group or a phenyl group, wherein the alkyl, aralkyl or phenyl groups may be substituted; and A represents a divalent group derived from a heterocyclic ring selected from a group consisting of imidazoles, 3H-indoles, thiazoles, benzothiazoles, naphthothiazoles, thianaphtheno-7′, 6′, 4,5-thiazoles, oxazoles, benzoxazoles, naphthoxazoles, selenazoles, benzoselenazoles, naphthoselenazoles, thiazolines, quinolines, isoquinolines, benzimidazoles and pyridines.

14. The electrophotographic photoreceptor as claimed in claim 2, wherein the binder is at least one member selected from the group consisting of a polyamide resin, a polyurethane resin, a polyester resin, and epoxy resin, a polyketone resin, a polycarbonate resin, polyvinyl ketone, polystyrene, poly-N-vinylcarbazole, or polyacrylamide.

15. The electrophotographic photoreceptor as claimed in claim 1, wherein the charge transporting material is at least one member selected from the group consisting of triphenylamine derivatives, polyarylalkane derivatives, pyrazoline derivatives and hydrazone derivatives.

* * * * *